United States Patent [19]

Aguirregomezcorta

[11] 3,948,527

[45] Apr. 6, 1976

[54] SIMULATED SPACE FLIGHT AND CAPSULE RECOVERY GAME

[76] Inventor: Enrique Aguirregomezcorta, 7555 SW. 29 St., Miami, Fla. 33155

[22] Filed: Nov. 25, 1974

[21] Appl. No.: 526,962

[52] U.S. Cl. 273/134 AD; 273/134 AG; 273/134 D

[51] Int. Cl.[2] ..... A63F 3/00

[58] Field of Search ..... 273/134

[56] References Cited

UNITED STATES PATENTS

| | | | |
|---|---|---|---|
| 614,543 | 11/1898 | Gerry | 273/134 AD |
| 1,558,288 | 10/1925 | Roman | 273/134 AD |
| 1,666,788 | 4/1928 | Palumbo | 273/134 AD |

*Primary Examiner*—Delbert B. Lowe

[57] ABSTRACT

A board game wherein two to four participants compete in moving a plurality of simulated space rockets to the center of the moon from a launch base and then the players substitute a simulated capsule for movement back to earth. Simulated recovery ships are then utilized for movement to the landing area to transport the capsules back to the launch base. Structure is provided for each participant to delay the progress of his or her opponent's vehicles which are in the form of simulated space rockets and capsules.

5 Claims, 7 Drawing Figures

SIMULATED SPACE FLIGHT AND CAPSULE RECOVERY GAME

OBJECTS AND ADVANTAGES OF THE PRESENT INVENTION

One of the principal objects of the present invention is to provide a space game for children or adults in which two to four participants compete in moving a plurality of space vehicles from a launch base to the center of the moon and then back to the launch base. The participant who first moves his plurality of space vehicles, three for example, from said launch base to the center of the moon and then back to the launch base is declared the winner of the game.

Another principal object of this invention is to provide means whereby each participant may delay the progress of his or her opponent's space vehicles as the play of the game progresses.

Yet another object of the instant invention is to provide a color coding of the play pieces, configurated to simulate space vehicles, and certain areas of the play board as they relate to each participant's play piece.

Another object of this invention is to provide a plurality of color coded move areas between each participant's launch base and the perimeter of the moon, including an annular path, formed by some of said areas, defining an orbital track around the moon.

A further object of this invention is to form the play board in a generally square configuration with launch base areas for four participants located adjacent the respective side edges thereof with a round simulation of the moon in the central area of the board. A plurality of color coded crater areas are defined in the moon area with four similarly color coded areas occupying the central area of the moon. Like color coded move areas extend from the respective launch bases to the orbital track.

A still further object of the present invention is to provide four color coded corner areas, simulating portions of the earth, and similarly color coded outer perimeter move areas for rescuing space capsules upon their return from the moon to the respective four corner areas, and returning same to the respective launch bases.

Another object of the present invention is to provide a pair of dice which the participants throw to determine the movement of their play pieces on their way to and from the moon as well as a means to delay the progress of opponent's play pieces.

A further object of this invention is to provide the game participants with simulated rocket ship play pieces for the journey to the moon, simulated space capsule play pieces for the return to earth from the moon and simulated rescue ship play pieces for transporting the capsules from their earth landing areas back to their launch bases.

Another object of this invention is to provide a game which may include two groups of cards (not shown) to further control the play of the game during the return to earth and rescue portions of said game. A color coded disc may be provided to each participant to intercept the opponent's rescue ships on their way to or from the rescue mission.

DETAILED DESCRIPTION OF THE INVENTION

Figure 1:
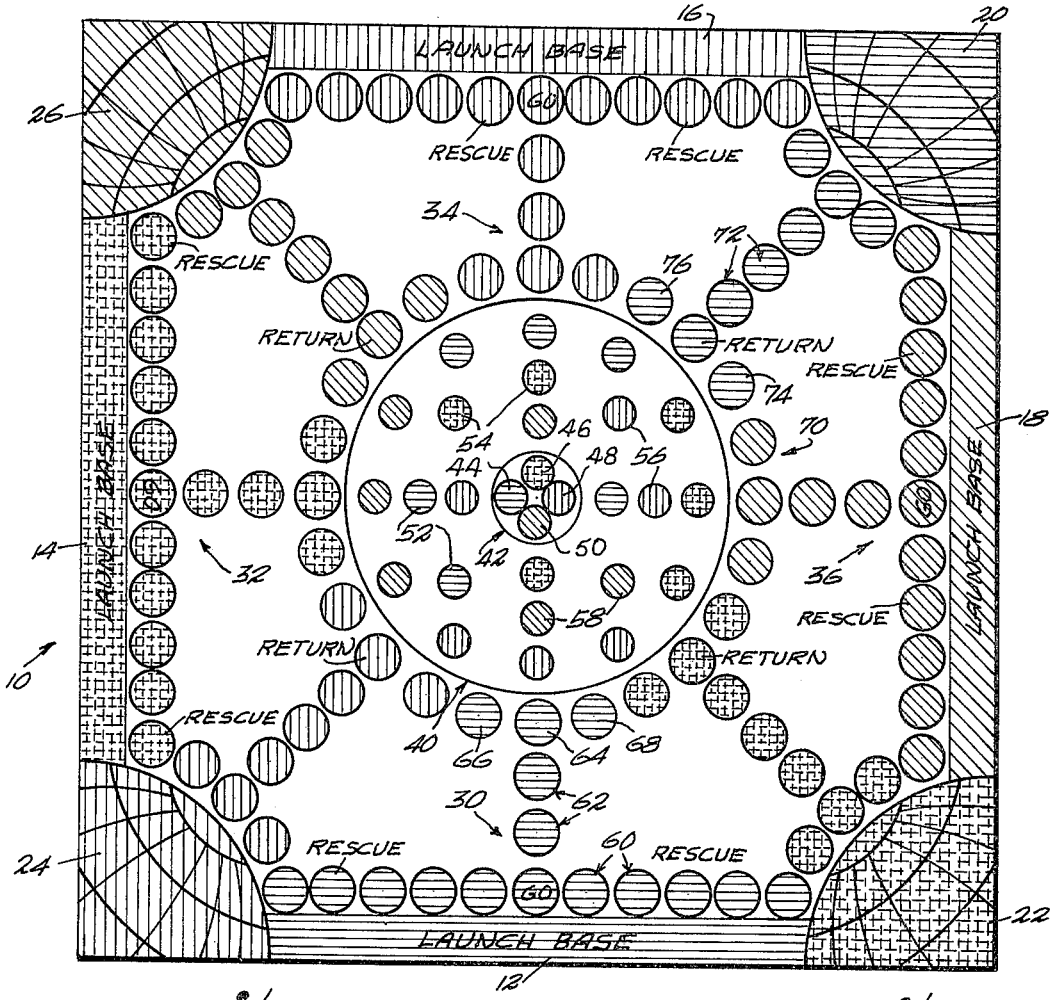
FIG. 1 is a plan view of the game board of the present invention.

With reference to the drawings in which like reference numerals designate like or corresponding parts throughout the various views and with particular reference to FIG. 1, the numeral 10 generally designates the game board of the present invention. As illustrated, the game board 10 is preferably square in configuration, each of the four edge portions of which comprise a rocket launch base for one of the game participants. Preferably, the four launch bases 12, 14, 16 and 18 are identified by distinctive colors, for example, blue, yellow, red and green as indicated by the shade linings thereon. Earth quadrants 20, 22, 24 and 26 are defined on the four corner areas of the board, each one of said quadrants being color keyed to one of the launch base areas. For example, earth quadrant 20 is color keyed to base 12, quadrant 22 to base 14, quadrant 24 to base 16 and quadrant 26 to base 18.

Pluralities of similarly color keyed play piece move areas 30, 32, 34 and 36 are located generally in the proximity of the respective launch base areas between said launch bases and a large central circle 40 which simulates the moon. A relatively small central area of the moon is defined by a small concentric circle 42. The central circle 42 contains four base areas 44, 46, 48 and 50, each of which is color keyed to one of the launch base areas. Between the outer and inner circles 40 and 42 are four like pluralities of color keyed moon crater play piece move areas such as 52, 54, 56 and 58.

All of the four sets of color keyed move areas and launch bases on the play board 10 are symmetrically arranged to afford all of the game participants equal opportunities to win. For example, considering the play areas lined for blue at the lower side of the play board 10 in FIG. 1, a row of blue move areas 60 parallels the length of the blue launch base 12. Centrally of said row 60, a line of like move areas 62 extends radially inwardly toward the moon center 42, the inner end move area 64 of which has one similarly color keyed move area on each side of it, such as 66 and 68, to cooperate with the other three groups of color keyed move areas 32, 34 and 36 to define portions of an orbital track 70 around the outer moon circle 40.

Each participant's play area also includes one of the earth quadrants, for example, the earth quadrant 20, lined for blue, forms the landing area for the game participant using the blue launch base and move areas. A radial line of similarly colored move areas extends from the moon 40 to each of the earth quadrants, such as at 72 to the blue quadrant 20. A pair of move areas such as 74 and 76 at the inner ends of the radial lines of move areas, such as 72, completes the orbital track 70.

Figure 3:
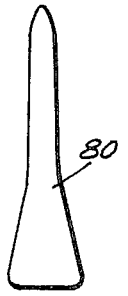
FIG. 3 is a plan view of a typical simulated rocket ship play piece used by each of the game participants.
Figure 4:
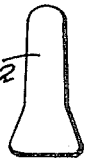
FIG. 4 is a plan view of a typical simulated space capsule play piece used by each of the game participants.
Figure 5:
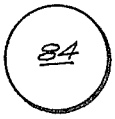
FIG. 5 is a plan view of a blocking disc play piece used by each of the game participants during the rescue aspect of the game.
Figure 6:
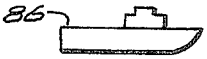
FIG. 6 is a plan view of a typical simulated rescue ship play piece used by each of the game participants.

Each participant is provided with appropriate play pieces such as a plurality of simulated rocket ships 80, three for example, FIG. 3, and a like number of return capsules 82, FIG. 4. The length of time consumed to play one game can be varied by the number of rocket ships and capsules used by the participants. As illustrated in FIGS. 5 and 6, each participant also receives one disc 84 and one simulated capsule recovery ship 86. It should be noted that all of the game participants' play pieces are color coded to the respective launch bases and play areas as above described.

A pair of dice 90 and 92, preferably of distinctive individual colors, such as red and white, are used to determine various movements of the play pieces. In addition, two stacks or decks of cards may be used to determine further play piece movements.

It should be noted that the word "Apollo", for example, or other suitably selected indicia, appears on two sides of the one die 90, the other four sides thereof being numbered 2, 3, 4 and 5. The other die 92 is conventional, the sides being numbered 1 through 6.

Figure 2:
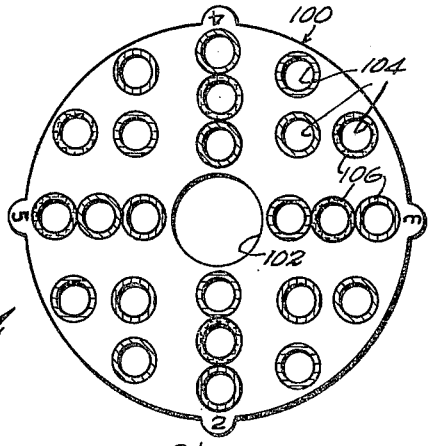
FIG. 2 is a plan view of a perforated disc used in the play of the game.
Figure 7:
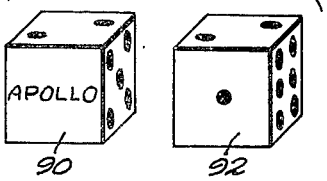
FIG. 7 is a perspective view of a pair of dice used by the participants in the play of the game.

To further enhance the play of the game, a perforated, colored disc 100, FIG. 2, may be provided. The disc 100 approximates the size of the moon circle 40, with a central opening 102 sized to conform with the moon center circle 42. The disc contains a plurality of apertures 104, 24 as illustrated, which are sized and positioned to conform with the size and positioning of the four color coded groups of moon craters 52, 54, 56 and 58. The margin of each of the apertures 104 is circumferentially color coded as at 106 to the color coding on the playboard, but not necessarily in conformity with the arrangement of the color coding on the moon craters. As further illustrated in FIG. 2, the peripheral edge of the disc is numbered 2, 3, 4 and 5 at 90° intervals.

Play of the Game

Each participant receives a set of color coded simulated rocket ships and capsules 80 and 82, three for example, one disc 84 and a simulated recovery ship 86, similarly color coded. The following description will be directed to the play of the game by a participant playing from the blue lined launch base 12. The above named play pieces will all be blue and will be initially placed on the blue launch base 12. The die 92 will be thrown and a rocket ship 80 will be advanced along the radial line of blue move areas 62, commencing with the area designated GO, to the area 64. From the area 64, subsequent throws of the die will move the rocket ship 80 once around the orbital track 70 back to the move area 66. All moves are directed to the right of the participant in a counterclockwise direction. From move area 66, in like manner, the simulated rocket ship 80 will next be moved around the concentric circle of crater move areas designated by the numerals 52, 54, 56 and 58 and then radially toward the moon center 42 as dictated by the numbers appearing on the die 92. For the final move to the proper color coded area 44 in the moon center 42, the participant must throw the exact number on the die as required by the number of remaining blue crater move areas to said center area 44.

The participant then throws the Apollo die 90 and places the perforated disc over the moon circle 40 with the peripheral number 2, 3, 4 or 5, corresponding to the number appearing on the Apollo die 90, facing himself. This is done only if one or more opponents have one or more rocket ships in the moon crater area.

All of such rocket ships, the color coding of which corresponds to the peripheral color of the aperture 104 through which they extend, must move back the number of spaces appearing on the Apollo die 90.

After the participant reaches the blue center base 44, he changes his rocket ship play piece 80 for one of his simulated capsule play pieces 82, and he may select a card from a "Return to the Earth" stack of cards, not shown. The card indicates at which color of move area he must commence in exiting from the moon. If the game is played without color coded "return to earth" cards, he will exit from the move area which corresponds to the color of his play piece. Subsequent throws of the die will move the capsule counterclockwise around the orbital track 70, until it reaches the inner "return" move area or the radially extending line of move areas corresponding to that of the color of his play piece, i.e., blue move areas 72, to the blue earth quadrant 20 in the case under consideration. The die 92, when thrown, must indicate the exact number of move areas needed for the final entry of the capsule 82 into the blue earth quadrant 20.

When the capsule 82 is in the earth quadrant 20, the participant sends his blue rescue ship 86 to pick it up, which is simulated by placing the capsule on the ship or moving it along with the ship to accompany it and return to the blue base 12 with it. This is accomplished by each player throwing the die 92 when he has a turn, and by moving his ship counterclockwise along the appropriate, perimeter move areas, such as 30, 36, 34 and 32 an appropriate number of spaces, as determined by the number resulting from his dice throw.

As stated, each player has one small color coded disc 84 which he places on any one of the rescue move areas paralleling his launch base. If any opponent's rescue ship stops, as determined by the count of the dice on the move area occupied by a disc 84 it must return to its launch base if the ship is not carrying a capsule 82 or to its earth quadrant if a capsule is aboard the ship. Each player may move his disc to a different move area each time he has a turn to throw the die.

The game may be varied by providing a second stack of cards (not shown) which are designated "rescue." If a rescue ship 86 lands on any of the move areas designated "Rescue" in its journey to or from an earth quadrant, the participant may take a card from the "rescue" stack. These cards instruct the participant to advance or go back a specific number of move areas. In all cases where a rocket is to land in the center of the moon, a capsule is to enter an earth quadrant, or a ship is to pick up a capsule or re-enter its launch base, the participant must throw an exact number on the die 92 to locate the play piece in the proper location.

Obviously, the above rules for playing the game may be changed or varied, as may the arrangement of the various base and move areas, without departing from the true spirit of the invention as defined in the appended claims.

What is claimed is:

1. A space game apparatus comprising,

A. a like plurality of play pieces for each game participant for movement around a game board including indicia defining,

1. a plurality of play piece launch bases,

2. a like plurality of earth quadrants,

3. a moon area including, a. an outer portion providing a plurality of crater move areas for the play pieces, b. a moon center portion providing a plurality of moon landing bases,

4. a plurality of first paths, each defined by a plurality of play piece move areas extending from one of said launch bases to said moon outer portion,

5. a plurality of second paths, each defined by a plurality of play piece move areas extending from said moon outer portion to one of said earth quadrants,

6. a plurality of third paths, each defined by a plurality of play piece move areas extending from one of said launch bases to one of said earth quadrants;

B. means to determine the length of each play piece move of each contestant, which means comprises a first die and wherein said participants' play pieces are color keyed to said launch bases, earth quadrants, crater move areas, moon landing bases and first, second and third paths; and C. an enlarged perforated disc, sized to fit over and generally cover said moon area with the exeption of said center portion and said crater move areas when said perforated disc is properly positioned in any one of four positions, said crater move areas and the perforations in said disc being symmetrically arranged to be in registration in all of said four positions, said disc being colored about the margins of each of the perforations to change the color code of the moon area.

2. A game apparatus as defined in claim 1 including a second die having four differently numbered sides, the outer periphery of said perforated disc being similarly numbered at spaced points to permit a game participant to position said disc in any one of said four positions relative to his launch base as determined by a throw of said second die.

3. A game apparatus as defined in claim 1 wherein each participant's play pieces include a plurality of simulated rocket ships, for a first phase of the game, for individual movement from a launch base along said first path to the moon area and onto the moon center portion by means of said crater move areas, and a like plurality of simulated rocket capsules for second and third phases of the game for movement from said moon center, to an earth quadrant along said second path, and then from said earth quadrant back to said launch base along said third path.

4. A game apparatus as defined in claim 3 wherein each participant's play pieces include a simulated rescue ship for movement, determined by said first die, from a launch base along said third path to said quadrant to pick up a capsule play piece therefrom and to bring it back to the launch base to accomplish said third phase.

5. A game apparatus as defined in claim 4 wherein each participant's play pieces include a small disc for positioning in any one of the move areas in a portion of said third path, adjacent to his or her launch base.

* * * * *